US007588085B2

(12) United States Patent
Acock et al.

(10) Patent No.: US 7,588,085 B2
(45) Date of Patent: Sep. 15, 2009

(54) METHOD TO IMPROVE THE INJECTIVITY OF FLUIDS AND GASES USING HYDRAULIC FRACTURING

(75) Inventors: Andrew Acock, Inverurie (GB); Hassan Chaabouni, Kalimantan Timur (ID); Mark Norris, Cults (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/561,986

(22) Filed: Nov. 21, 2006

(65) Prior Publication Data

US 2007/0125536 A1 Jun. 7, 2007

Related U.S. Application Data

(60) Provisional application No. 60/748,330, filed on Dec. 7, 2005.

(51) Int. Cl.
*E21B 43/267* (2006.01)

(52) U.S. Cl. ..... 166/308.1; 166/280.1; 166/308.2

(58) Field of Classification Search ..... 166/308.1, 166/308.2, 280.1
See application file for complete search history.

(56) References Cited

U.S. PATENT DOCUMENTS

| | | | | |
|---|---|---|---|---|
| 3,121,464 | A * | 2/1964 | Huitt et al. | 166/280.1 |
| 3,364,995 | A * | 1/1968 | Atkins et al. | 166/280.1 |
| 3,399,727 | A * | 9/1968 | Graham et al. | 166/280.1 |
| 3,929,191 | A | 12/1975 | Graham | |
| 4,212,747 | A | 7/1980 | Swanson | |
| 4,293,036 | A | 10/1981 | Swanson | |
| 5,253,707 | A | 10/1993 | Schmidt | |
| 5,711,376 | A * | 1/1998 | Sydansk | 166/308.6 |
| 7,004,255 | B2 | 2/2006 | Boney | |
| 7,255,169 | B2 * | 8/2007 | van Batenburg et al. | 166/280.2 |
| 2006/0113078 | A1 | 6/2006 | Nguyen | |
| 2006/0124309 | A1 | 6/2006 | Nguyen | |
| 2006/0175058 | A1 | 8/2006 | Nguyen | |

OTHER PUBLICATIONS

SPE 90698; Harold D. Brannon, Mark R. Malone, Allan R. Rickards, William D. Wood, J. Randall Edgeman, BJ Services Company & Josh L. Bryant; Maximizing Fracture Conductivity With Proppant Partial Monolayers: Theoretical Curiosity or Highly Productive Reality?; Society of Petroleum Engineers; 2004; SPE Annual Technical Conference and Exhibition in Houston, Texas; Sep. 26-29, 2004.

* cited by examiner

*Primary Examiner*—William P Neuder
(74) *Attorney, Agent, or Firm*—David Cate; Robin Nava; Dale Gaudier

(57) ABSTRACT

A method of improving injectivity of fluid, particularly produced water, in enhanced hydrocarbon recovery is disclosed. The method includes introducing a fracturing fluid into the subterranean formation to create a fracture, and introducing proppant into the fracturing fluid to form a single layer of proppant in the fracture. The fracturing fluid can be formed from produced water. Alternatively, the produced water is introduced after a fracturing fluid, other than the produced water, has been introduced to create a fracture. By reducing the amount of proppant and by using much larger proppant, a larger flow path through the fracture is created, thereby increasing the injectivity of produced water.

14 Claims, 2 Drawing Sheets

METHOD TO IMPROVE THE INJECTIVITY OF FLUIDS AND GASES USING HYDRAULIC FRACTURING

CROSS-REFERENCE TO RELATED APPLICATION

The present application claims priority of a provisional application Ser. No. 60/748,330, titled "Method to Improve Injectivity of Produced Water using Hydraulic Fracturing" filed Dec. 7, 2005, the contents of which are incorporated by reference herein in its entirety.

FIELD OF THE DISCLOSURE

The present disclosure relates generally to subterranean formation stimulation, and more particularly to methods of improving injectivity of fluids.

BACKGROUND

The statements in this section merely provide background information related to the present disclosure and may not constitute prior art.

Hydraulic fracturing is one of the techniques used in enhanced hydrocarbon recovery. Hydraulic fracturing involves pumping a fracturing fluid into an injection well and against the face of the formation at a pressure and flow rate at least sufficient to overcome the in-situ stresses and to initiate and/or extend a fracture or fractures into the formation. The injection well is at a distance from the production well and a fracturing fluid is injected to maintain reservoir pressure and help displace oil towards the production wells.

Referring to FIG. 1, in a conventional hydraulic fracturing method, a fracturing fluid (not shown) which carries proppant particles 10 is injected into an injection well (not shown) to initiate a fracture 12 in the hydrocarbon-containing formation 14. The fracturing fluid is generally viscous to transport the proppant articles 10 into the fracture 12 being created. The proppant particles 10 prevent the fracture 12 from closing when the pumping pressure is released. The proppant particles 10 are generally 20/40 to 12/18 mesh sand, bauxite, ceramic beads, etc. The proppant suspension and transport ability of the treatment base fluid traditionally depends on the type of viscosifying agent added.

Details about hydraulic fracturing can be found in the following references: Stimulation Engineering Handbook, John W. Ely, Pennwell Publishing Co., Tulsa, Okla. (1994); U.S. Pat. No. 5,551,516 to Normal et al.; "Oilfield Applications", Encyclopedia of Polymer Science and Engineering, vol. 10, pp. 328-366 (John Wiley & Sons, Inc. New York, N.Y., 1987) and references cited therein, the contents of which are incorporated in their entirety.

When wells penetrating hydrocarbon-producing subterranean formations are produced, water often accompanies the oil and gas. The water, commonly referred to as "produced water", can be the result of a water producing zone communicated with the oil and gas producing formation by fractures, high permeability streaks and the like. This may also be caused by a variety of other occurrences which are well known to those skilled in the art such as water coning, water cresting, bottom water, channeling at the well bore, etc.

It is known to use produced water as a fracturing fluid in the hydraulic fracturing process. In an offshore hydrocarbon recovery operation, injecting produced water into the injection wells is particularly desirable because dumping produced water into the sea may contaminate sea water given that the produced water contains hydrocarbon, emulsions, and solids contamination even after being treated. Using the produced water in hydraulic fracturing, however, may cause plugging of the injection wells due to the higher temperature of the produced water, the inclusion of emulsions and solid contamination. Despite the efforts to treat the produced water through surface treating facilities to remove the hydrocarbons and solid materials, there is still a small amount (<20 parts per million) of oil remaining in the produced water. With the high injection rates (e.g. 50,000 barrels per day) required in the offshore operation, these solids and hydrocarbon sludge can quickly accumulate on the pore throats of the formation taking the water.

When the pumps cannot deliver the required pressures to fracture the formations, resulting in the reduction of capacity to inject the produced water, a solution is to inject cold sea water, instead of produced water, into the injection well. Injecting the cold sea water, however, would change the rock properties and create small fractures called thermal fractures. These thermal fractures bypass the originally created fracture (s) and create a new injection path and are thus undesirable.

Therefore, it would be desirable to have methods which use produced water injection to enhance hydrocarbon recovery wherein the injection rates of produced water are improved while injectivity decline is minimized.

SUMMARY

A method of treating a subterranean formation adjacent an injection well including introducing a fracturing fluid into the subterranean formation to create a fracture, and introducing proppant into the fracturing fluid to form a single layer of proppant in the fracture. The single layer of proppant may be non-contiguous (a partial monolayer), and the proppant loading level is less than about 0.15 lb per gallon of the fracturing fluid. The fracturing fluid may include a viscosifying agent that may be a polymer, either crosslinked or linear, a viscoelastic surfactant, clay (Bentonite and attapulgite), a fibre, or any combination thereof.

Methods of the invention are useful using any fluid or gas used for operations related to injection, produced water injection, reservoir flooding (i.e. to sweep hydrocarbon between and injection well and a production well), gas storage (i.e. where gas in injected into a reservoir to be recovered later), and the like.

DRAWINGS

The drawings described herein are for illustration purposes only and are not intended to limit the scope of the present disclosure in any way.

Corresponding reference numerals indicate corresponding parts throughout the several views of the drawings.

DETAILED DESCRIPTION

The description and examples are presented solely for the purpose of illustrating the preferred embodiments of the invention and should not be construed as a limitation to the scope and applicability of the invention. While the compositions of the present invention are described herein as comprising certain materials, it should be understood that the composition could optionally comprise two or more chemically different materials. In addition, the composition can also comprise some components other than the ones already cited. In the summary of the invention and this detailed description, each numerical value should be read once as modified by the term "about" (unless already expressly so modified), and then read again as not so modified unless otherwise indicated in context. Also, in the summary of the invention and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possession of the entire range and all points within the range.

At the outset, it should be noted that in the development of any such actual embodiment, numerous implementation—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure.

Methods of the invention are useful using any fluid or gas used for operations related to injection, produced water injection, reservoir flooding (i.e. to sweep hydrocarbon between and injection well and a production well), gas storage (i.e. where gas in injected into a reservoir to be recovered later), and the like.

Figure 1:
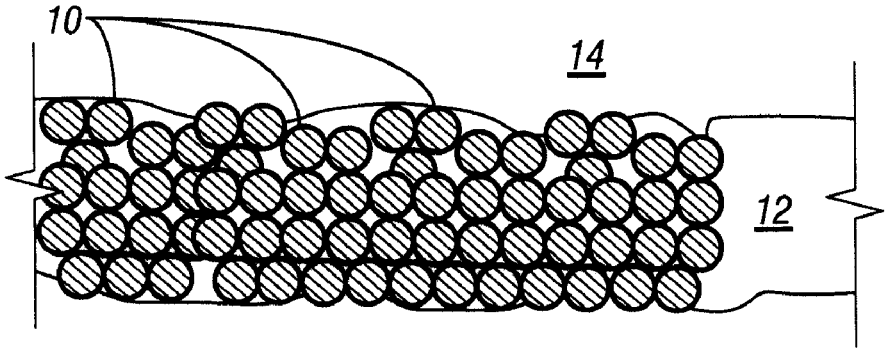
FIG. 1 (Prior Art)
FIG. 1 is a partial cross-sectional view of a proppant containing fracture created by a conventional prior art hydraulic fracturing method.
Figure 2:
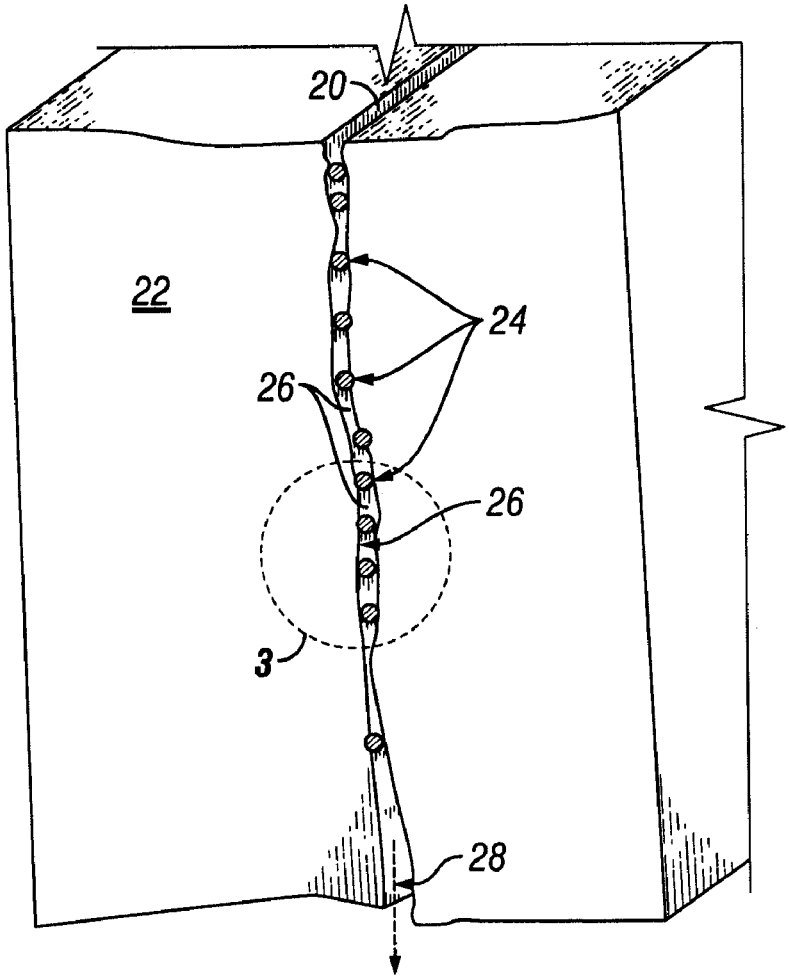
FIG. 2 is a cross-sectional view of a fracture created by a hydraulic fracturing method in accordance with the teachings of the present disclosure.
Figure 3:
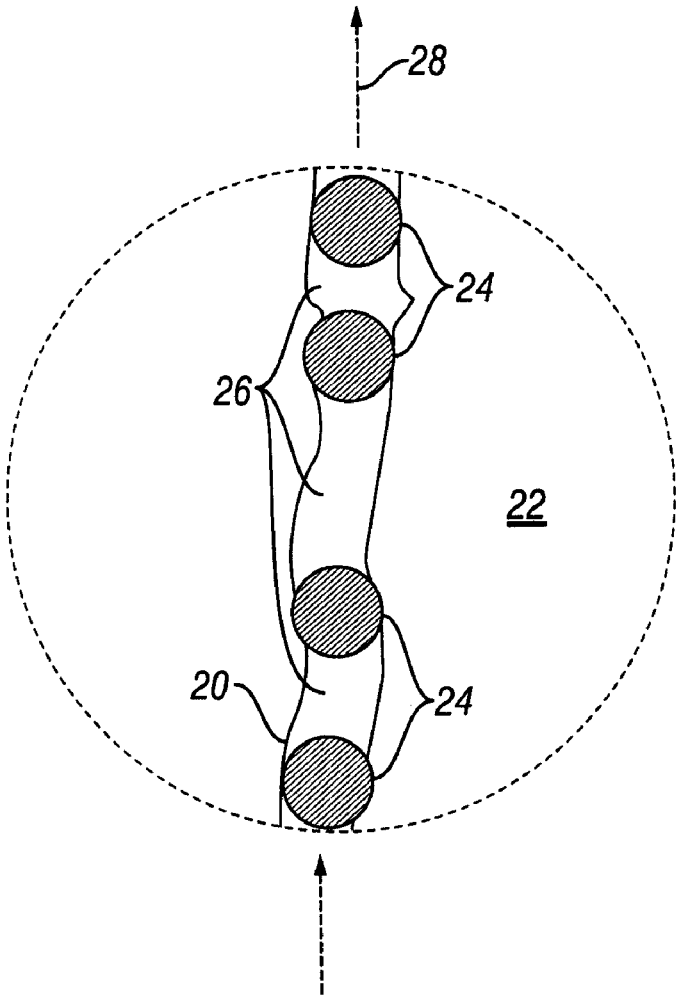
FIG. 3 is an enlarged view of portion A of FIG. 2.

Referring to FIGS. 2 and 3, a fracture created by a hydraulic fracturing method in accordance with the teachings of the present disclosure is generally indicated by reference numeral 20. The fracture 20 is created by injecting a fracturing fluid (not shown) against the face of the formation 22. The fracturing fluid carries a single layer of proppant 24, which may be non-continuous and thus a plurality of gaps 26 formed between the proppant 24, thus forming a partial monolayer of proppant. As a result, more fracture face is unencumbered leading to greater exposed face area for injection and/or increase in fluid injection rate into the formation, and the average gap between prop grains is much greater leading to less plugging potential (i.e. "pore throat" size is greater versus conventional propped fractures). Also, this approach allows such improvements as: a decrease in occurrences of pressuring out since the large fracture area and fracture penetration into the reservoir helps to dissipate wellbore injection pressure rapidly; decrease in plugging due to injection water fines and/or emulsions since the greater sandface area reduces well sensitivity to plugging; and an increase in average flow velocities through the sandface reduces tendency for fines mobilisation during crossflow.

The proppant 24 creates a propped flow path 28 through the gaps 26 between the proppant 24. To create a single layer of proppant, the proppant grains used are much larger than conventionally used and in lower concentrations. By reducing the amount of proppant and by using much larger proppant, a much larger flow path through the fracture 20 is created. Because the proppant load is very low, the proppant 24 is not continuous in the fracture 20, thereby creating highly conductive gaps 26 between the proppant 22. As a result, the proppant may function as pit props supporting the fracture during injection and allowing the injection produced water containing small diameter produced particles, perhaps less than 50 microns in average diameter.

Given the stresses experienced by a single grain of proppant, the proppant used in the present disclosure should be of sufficient strength to overcome the load, as opposed to conventional fracture treatment where multiple grains of proppant spread the load. As the pressure bleeds off and the fracture 20 closes, a force is applied to the proppant 24 remaining in the fracture 20, which is the difference between the pressure in the fluid around the proppant 24 and the minimum formation stress. In most cases the minimum stress is in the order of 0.65 to 0.75 psi/ft while the reservoir pressure in an injection well is usually around the hydrostatic gradient (0.45 psi/ft).

Any suitable proppant may be used in embodiments of the invention. The proppant may be, by nonlimiting example, a high strength proppant (density 3.4-3.6 sgu) in all sizes from 40/70 to 8/12 mesh; intermediate strength proppant (density 3.1-3.3 sgu) in all sizes from 40/70 to 8/12 mesh; even light weight proppant (density 2.6-2.8 sgu) in all sizes from 40/70 to 8/12 mesh; or natural sand (density 2.5-2.8 sgu) in all sizes from 40/70 to 8/12 mesh.

As an example, a 0.1 lb/gal of 8/14 mesh high strength proppant will result in a loading sufficient to support the closure stresses experienced at the Forties field and low enough to provide sufficient gaps 26 for injection of the solids between the gaps 26. The rock strength at Forties (UCS1200 psi, Youngs Mod 1 million) is high enough to expect to see 40% of embedment assuming with a partial mono layer of 16%. This will leave a fracture width of about 1.37 mm sufficient to allow injection of produced solids with particle less than 50 microns.

In some embodiments of the invention, the proppant used is preferably Carboceramic 8/14 mesh size (CARBOCERAMICS (CARBOPROP® Proppants)) with a loading level less than about 0.1 lb/gal of proppant based upon volume of the fracturing fluid. The proppant has an average diameter of about 1.7 mm, and the net stress on the proppant after closure is expected to be around 2500 psi. The above-described proppant facilitates the injection of produced water into injection wells and defers and minimizes plugging by increasing the fracture face area open to injection. This is achieved by using a large proppant size and reducing the loading to create a narrow fracture propped by a thin or single layer of proppant.

Any proppant (gravel) can be used, provided that it is compatible with the base and the bridging-promoting materials if the latter are used, the formation, the fluid, and the desired results of the treatment. Such proppants (gravels) can be natural or synthetic, coated, or contain chemicals; more than one can be used sequentially or in mixtures of different sizes or different materials. Proppants and gravels in the same or different wells or treatments can be the same material and/or the same size as one another and the term "proppant" is intended to include gravel in this discussion. Proppant is selected based on the rock strength, injection pressures, types of injection fluids, or even completion design. Preferably, the proppant materials include, but are not limited to, sand, sintered bauxite, glass beads, ceramic materials, naturally occurring materials, or similar materials. Mixtures of proppants can be used as well. Naturally occurring materials may be underived and/or unprocessed naturally occurring materials, as well as materials based on naturally occurring materials that have been processed and/or derived. Suitable examples of naturally occurring particulate materials for use as proppants include, but are not necessarily limited to: ground or crushed shells of nuts such as walnut, coconut, pecan, almond, ivory nut, brazil nut, etc.; ground or crushed seed shells (including fruit pits) of seeds of fruits such as plum, olive, peach, cherry, apricot, etc.; ground or crushed seed shells of other plants such as maize (e.g., corn cobs or corn kernels), etc.; processed wood materials such as those derived from woods such as oak, hickory, walnut, poplar, mahogany, etc., including such woods that have been processed by grinding, chipping, or other form of particalization, processing, etc, some nonlimiting examples of which are proppants supplied under the tradename LiteProp™ available from BJ Services Co., made of walnut hulls impregnated and encapsulated with resins. Further information on some of the above-noted compositions thereof may be found in Encyclopedia of Chemical Technology, Edited by Raymond E. Kirk and Donald F. Othmer, Third Edition, John Wiley & Sons, Volume 16, pages 248-273 (entitled "Nuts"), Copyright 1981, which is incorporated herein by reference.

The proppant particles 24 may be resin-coated (precured, partially cured and fully curable) to further improve the strength, clustering ability, and flow back properties of the proppant.

Figure 4:
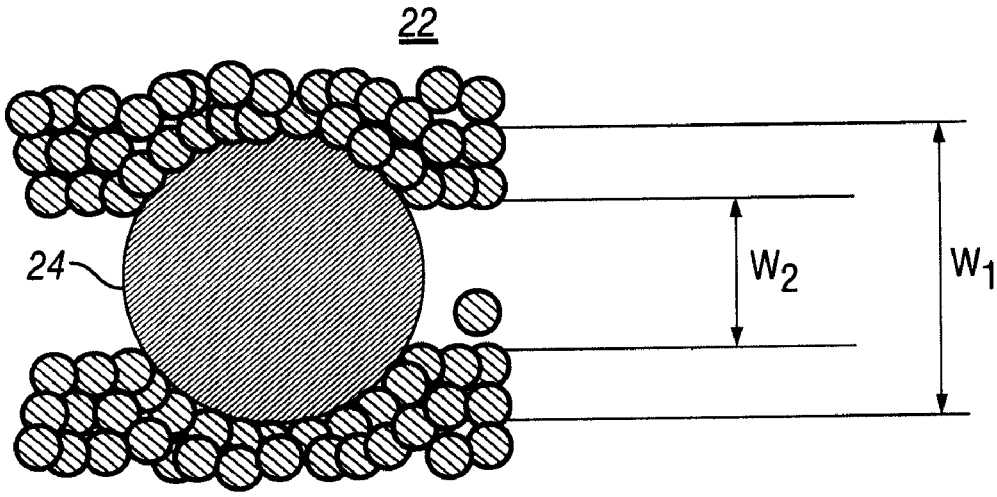
FIG. 4 is a view showing embedment of a proppant grain.

Referring to FIG. 4, as the formation 22 closes, the proppant 24 may be point loaded, and proppant embedment will result in a reduced fracture width $W_2$. Calculations performed on a typical sand with a Brinell Hardness of 40,000 psi indicate that the embedment ($W_1$-$W_2$) will be limited to about 0.33 mm leaving a fracture width $W_2$ of approximately 1.37 mm after closure. Despite the proppant embedment, the technical study performed on a candidate well in the Forties field suggests that the fracturing method in accordance with the present disclosure can improve the injection of produced fluids.

The concentration of proppant may be any suitable concentration, and will typically be about 0.15 lbs or less of proppant added per gallon (lbs/gal) of fracturing fluid. Generally, the proppant can be present in an amount of from about 0.15 to less than about 0.001 lbs/gal of fracturing fluid, with a lower limit of polymer being no less than about 0.001, 0.005, 0.01, 0.02, 0.03, 0.04, 0.05, 0.06, 0.07, 0.08, 0.09, 0.10, 0.11, 0.12, 0.13 or 0.14 pounds per gallons of fluid. The upper limit may be about 0.15 pounds per gallon or less, less that about 0.15 pounds per gallon, or even no greater than about 0.14, 0.13, 0.12, 0.11, 0.10, 0.09, 0.07, 0.05, 0.03, or 0.01 pounds per gallon of total fluid. The amount of proppant added is decreased over typical proppant loadings so as to develop a non continuous monolayer of proppant in the fracture. The proppant loading, however, can be adjusted to deal with expected stresses in the fracture to prevent crushing of the proppant and embedment. The larger diameter proppant is required to compensate for embedment experience when the fracture closes. Calculations conducted show that after closure some of the proppant grain is lost to embedment by the rock. This varies with the rock strength, effective stress experience after fracture closure and the proppant loading (number of gains in contact with the fracture and the proppant diameter).

The fracturing fluid may comprise an aqueous medium which is based upon, at least in part, produced water. The aqueous medium may also contain some water, seawater, or brine. When the aqueous medium is a brine, which is water comprising an inorganic salt or organic salt, preferred inorganic salts include alkali metal halides, more preferably potassium chloride. The carrier brine phase may also comprise an organic salt more preferably sodium or potassium formate. Preferred inorganic divalent salts include calcium halides, more preferably calcium chloride or calcium bromide. Sodium bromide, potassium bromide, or cesium bromide may also be used. The salt is chosen for compatibility reasons i.e., where the reservoir drilling fluid used a particular brine phase and the completion/clean up fluid brine phase is chosen to have the same brine phase.

Preferably, the fracturing fluid includes a viscosifying agent that may be a polymer, either crosslinked or linear, a viscoelastic surfactant, clay (Bentonite and attapulgite), a fibre, or any combination thereof. For hydraulic fracturing or gravel packing, or a combination of the two, aqueous fluids for pads or for forming slurries are generally viscosified. A portion of the polymers also typically ends up as major (or sole) components of a filter cake. On the other hand, certain surfactants, especially viscoelastic surfactants ("VES's") form appropriately sized and shaped micelles that add viscosity to aqueous fluids. Small amounts of polymers may be used to increase the viscosity or for purposes, for example, as friction reducers. Breakers may also be used with VES's.

Examples of some suitable polymers useful as viscosifying agents include, but are not necessarily limited to, guar gums, high-molecular weight polysaccharides composed of mannose and galactose sugars, or guar derivatives such as hydropropyl guar (HPG), carboxymethyl guar (CMG), and carboxymethylhydropropyl guar (CMHPG). Cellulose derivatives such as hydroxyethylcellulose (HEC) or hydroxypropylcellulose (HPC) and carboxymethylhydroxyethylcellulose (CMHEC) may also be used. Any polymer may be useful in either crosslinked form, or without crosslinker in linear form. Biopolymers, such as Xanthan, diutan, and scleroglucan, are also useful as viscosifying agents in some embodiments according to the invention. Polyacrylamide and polyacrylate polymers and copolymers are used typically for high-temperature applications. Of these viscosifying agents, guar, hydroxypropyl guar and carboxymethlyhydroxyethyl guar are preferably used. Other polymers which are useful include hydrophobically-modified hydroxyalkyl galactomannans, e.g., $C_1$-$C_{18}$-alkyl-substituted hydroxyalkyl galactomannans, e.g., wherein the amount of alkyl substituent groups is preferably about 2% by weight or less of the hydroxyalkyl galactomannan; and poly(oxyalkylene)-grafted galactomannans (see, e.g., A. Bahamdan & W. H. Daly, in Proc. 8PthP Polymers for Adv. Technol. Int'l Symp. (Budapest, Hungary, September 2005) (PEG- and/or PPG-grafting is illustrated, although applied therein to carboxymethyl guar, rather than directly to a galactomannan)). Poly (oxyalkylene)-grafts thereof can comprise two or more than two oxyalkylene residues; and the oxyalkylene residues can be $C_1$-$C_4$ oxyalkylenes. Mixed-substitution polymers comprising alkyl substituent groups and poly(oxyalkylene) substituent groups on the hydroxyalkyl galactomannan are also useful herein. In various embodiments of substituted hydroxyalkyl galactomannans, the ratio of alkyl and/or poly (oxyalkylene) substituent groups to mannosyl backbone residues can be about 1:25 or less, i.e. with at least one substituent per hydroxyalkyl galactomannan molecule; the ratio can be: at least or about 1:2000, 1:500, 1:100, or 1:50; or up to or about 1:50, 1:40, 1:35, or 1:30. Combinations of galactomannan polymers according to the present disclosure can also be used.

Also, associative polymers for which viscosity properties are enhanced by suitable surfactants and hydrophobically modified polymers can be used, such as cases where a charged polymer in the presence of a surfactant having a charge that is opposite to that of the charged polymer, the surfactant being capable of forming an ion-pair association with the polymer resulting in a hydrophobically modified polymer having a plurality of hydrophobic groups, as described published U.S. Pat. App. No. US 2004209780, Harris et. al., incorporated hereinafter by reference.

In some embodiments, the polymeric viscosifying agent is crosslinked with a suitable crosslinker. Suitable crosslinkers for the polymeric viscosifying agents can comprise a chemical compound containing an ion such as, but not necessarily limited to, chromium, iron, boron, titanium, and zirconium. The borate ion is a particularly suitable crosslinking agent.

When incorporated, the polymer based viscosifier may be present at any suitable concentration. In various embodiments hereof, the gelling agent can be present in an amount of from about 10 to less than about 60 pounds per thousand gallons of liquid phase, or from about 15 to less than about 50 pounds per thousand gallons, from about 20 to about 50 pounds per thousand gallons, from 25 to about 45 pounds per thousand gallons of total fluid, or even from about 27 to about 42 pounds per thousand gallons of total fluid. Generally, the polymer can be present in an amount of from about 10 to less than about 60 pounds per thousand gallons of total fluid, with a lower limit of polymer being no less than about 10, 11, 12, 13, 14, 15, 16, 17, 18, or 19 pounds per thousand gallons of total fluid, and the upper limit being less than about 60 pounds per thousand gallons total fluid, no greater than 59, 54, 49, 44, 39, 34, 30, 29, 28, 27, 26, 25, 24, 23, 22, 21, or 20 pounds per thousand gallons of total fluid. In some embodiments, the polymers can be present in an amount of about 40 pounds per thousand gallons total fluid. Fluids incorporating polymer based viscosifiers based viscosifiers may have any suitable viscosity, preferably a viscosity value of about 50 mPa-s or greater at a shear rate of about 100 $s^{-1}$ at treatment temperature, more preferably about 75 mPa-s or greater at a shear rate of about 100 $s^{-1}$, and even more preferably about 100 mPa-s or greater.

In some embodiments of the invention, a viscoelastic surfactant (VES) is used as a viscosifying agent. The VES may be selected from the group consisting of cationic, anionic, zwitterionic, amphoteric, nonionic and combinations thereof. Some nonlimiting examples are those cited in U.S. Pat. No. 6,435,277 (Qu et al.) and U.S. Pat. No. 6,703,352 (Dahayanake et al.), each of which are incorporated herein by reference. The viscoelastic surfactants, when used alone or in combination, are capable of forming micelles that form a structure in an aqueous environment that contribute to the increased viscosity of the fluid (also referred to as "viscosifying micelles"). These fluids are normally prepared by mixing in appropriate amounts of VES suitable to achieve the desired viscosity. The viscosity of VES fluids may be attributed to the three dimensional structure formed by the components in the fluids. When the concentration of surfactants in a viscoelastic fluid significantly exceeds a critical concentration, and in most cases in the presence of an electrolyte, surfactant molecules aggregate into species such as micelles, which can interact to form a network exhibiting viscous and elastic behavior.

Nonlimiting examples of suitable viscoelastic surfactants useful for viscosifying some fluids include cationic surfactants, anionic surfactants, zwitterionic surfactants, amphoteric surfactants, nonionic surfactants, and combinations thereof.

Some useful zwitterionic surfactants have the formula:

$$RCONH—(CH_2)_a(CH_2CH_2O)_m(CH_2)_b—N^+(CH_3)_2—(CH_2)_{a'}(CH_2CH_2O)_{m'}(CH_2)_{b'}COO^-$$

in which R is an alkyl group that contains from about 17 to about 23 carbon atoms which may be branched or straight chained and which may be saturated or unsaturated; a, b, a', and b' are each from 0 to 10 and m and m' are each from 0 to 13; a and b are each 1 or 2 if m is not 0 and (a+b) is from 2 to 10 if m is 0; a' and b' are each 1 or 2 when m' is not 0 and (a'+b') is from 1 to 5 if m is 0; (m+m') is from 0 to 14; and $CH_2CH_2O$ may also be $OCH_2CH_2$.

Preferred zwitterionic surfactants include betaines. Two suitable examples of betaines are BET-O and BET-E. The surfactant in BET-O-30 is shown below; one chemical name is oleylamidopropyl betaine. It is designated BET-O-30 because as obtained from the supplier (Rhodia, Inc. Cranbury, N.J., U.S.A.) it is called Mirataine BET-O-30 because it contains an oleyl acid amide group (including a $C_{17}H_{33}$ alkene tail group) and contains about 30% active surfactant; the remainder is substantially water, sodium chloride, and propylene glycol. An analogous material, BET-E-40, is also available from Rhodia and contains an erucic acid amide group (including a $C_{21}H_{41}$ alkene tail group) and is approximately 40% active ingredient, with the remainder being substantially water, sodium chloride, and isopropanol. VES systems, in particular BET-E-40, optionally contain about 1% of a condensation product of a naphthalene sulfonic acid, for example sodium polynaphthalene sulfonate, as a rheology modifier, as described in U.S. Patent Application Publication No. 2003-0134751, incorporated in its entirety herein by reference. The surfactant in BET-E-40 is also shown below; one chemical name is erucylamidopropyl betaine. As-received concentrates of BET-E-40 were used in the experiments reported below, where they will be referred to as "VES" and "VES-1". BET surfactants, and other VES's that are suitable for the present Invention, are described in U.S. Pat. No. 6,258,859, incorporated in its entirety herein by reference. According to that patent, BET surfactants make viscoelastic gels when in the presence of certain organic acids, organic acid salts, or inorganic salts; in that patent, the inorganic salts were present at a weight concentration up to about 30%. Co-surfactants may be useful in extending the brine tolerance, and to increase the gel strength and to reduce the shear sensitivity of the VES-fluid, in particular for BET-O-type surfactants. An example given in U.S. Pat. No. 6,258,859, incorporated in its entirety herein by reference, is sodium dodecylbenzene sulfonate (SDBS), also shown below. Other suitable co-surfactants include, for example those having the SDBS-like structure in which x=5–15; preferred co-surfactants are those in which x=7 –15. Still other suitable co-surfactants for BET-O-30 are certain chelating agents such as trisodium hydroxyethylethylenediamine triacetate. The rheology enhancers of the present invention may be used with viscoelastic surfactant fluid systems that contain such additives as co-surfactants, organic acids, organic acid salts, and/or inorganic salts.

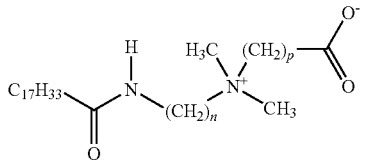

Surfactant in BET-O-30 (when n=3 and p=1)

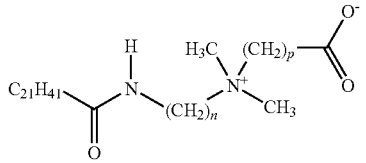

Surfactant in BET-E-40 (when n=3 and p=1)

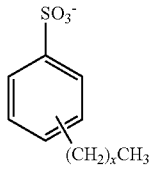

SDBS (when x=11 and the counterion is $Na^+$)

Some embodiments of the present invention use betaines; most preferred embodiments use BET-E-40. Although experiments have not been performed, it is believed that mixtures of betaines, especially BET-E-40, with other surfactants are also suitable. Such mixtures are within the scope of embodiments of the invention.

Other betaines that are suitable include those in which the alkene side chain (tail group) contains 17-23 carbon atoms (not counting the carbonyl carbon atom) which may be branched or straight chained and which may be saturated or unsaturated, n=2–10, and p=1–5, and mixtures of these compounds. More preferred betaines are those in which the alkene side chain contains 17-21 carbon atoms (not counting the carbonyl carbon atom) which may be branched or straight chained and which may be saturated or unsaturated, n=3–5, and p=1–3, and mixtures of these compounds. These surfactants are used at a concentration of about 0.5 to about 10%, preferably from about 1 to about 5%, and most preferably from about 1.5 to about 4.5%.

Exemplary cationic viscoelastic surfactants include the amine salts and quaternary amine salts disclosed in U.S. Pat. Nos. 5,979,557, and 6,435,277 which have a common Assignee as the present application and which are hereby incorporated by reference.

Examples of suitable cationic viscoelastic surfactants include cationic surfactants having the structure:

$$R_1N^+(R_2)(R_3)(R_4)X^-$$

in which $R_1$ has from about 14 to about 26 carbon atoms and may be branched or straight chained, aromatic, saturated or unsaturated, and may contain a carbonyl, an amide, a retroamide, an imide, a urea, or an amine; $R_2$, $R_3$, and $R_4$ are each independently hydrogen or a $C_1$ to about $C_6$ aliphatic group which may be the same or different, branched or straight chained, saturated or unsaturated and one or more than one of which may be substituted with a group that renders the $R_2$, $R_3$, and $R_4$ group more hydrophilic; the $R_2$, $R_3$ and $R_4$ groups may be incorporated into a heterocyclic 5- or 6-member ring structure which includes the nitrogen atom; the $R_2$, $R_3$ and $R_4$ groups may be the same or different; $R_1$, $R_2$, $R_3$ and/or $R_4$ may contain one or more ethylene oxide and/or propylene oxide units; and $X^-$ is an anion. Mixtures of such compounds are also suitable. As a further example, $R_1$ is from about 18 to about 22 carbon atoms and may contain a carbonyl, an amide, or an amine, and $R_2$, $R_3$, and $R_4$ are the same as one another and contain from 1 to about 3 carbon atoms.

Cationic surfactants having the structure $R_1N^+(R_2)(R_3)(R_4)X^-$ may optionally contain amines having the structure $R_1N(R_2)(R_3)$. It is well known that commercially available cationic quaternary amine surfactants often contain the corresponding amines (in which $R_1$, $R_2$, and $R_3$ in the cationic surfactant and in the amine have the same structure). As received commercially available VES surfactant concentrate formulations, for example cationic VES surfactant formulations, may also optionally contain one or more members of the group consisting of alcohols, glycols, organic salts, chelating agents, solvents, mutual solvents, organic acids, organic acid salts, inorganic salts, oligomers, polymers, copolymers, and mixtures of these members. They may also contain performance enhancers, such as viscosity enhancers, for example polysulfonates, for example polysulfonic acids, as described in copending U.S. Patent Application Publication No. 2003-0134751 which has a common Assignee as the present application and which is hereby incorporated by reference.

Another suitable cationic VES is erucyl bis(2-hydroxyethyl) methyl ammonium chloride, also known as (Z)-13 docosenyl-N-N-bis (2-hydroxyethyl) methyl ammonium chloride. It is commonly obtained from manufacturers as a mixture containing about 60 weight percent surfactant in a mixture of isopropanol, ethylene glycol, and water. Other suitable amine salts and quaternary amine salts include (either alone or in combination in accordance with the invention), erucyl trimethyl ammonium chloride; N-methyl-N,N-bis(2-hydroxyethyl) rapeseed ammonium chloride; oleyl methyl bis(hydroxyethyl) ammonium chloride; erucylamidopropyltrimethylamine chloride, octadecyl methyl bis(hydroxyethyl) ammonium bromide; octadecyl tris(hydroxyethyl) ammonium bromide; octadecyl dimethyl hydroxyethyl ammonium bromide; cetyl dimethyl hydroxyethyl ammonium bromide; cetyl methyl bis(hydroxyethyl) ammonium salicylate; cetyl methyl bis(hydroxyethyl) ammonium 3,4,-dichlorobenzoate; cetyl tris(hydroxyethyl) ammonium iodide; cosyl dimethyl hydroxyethyl ammonium bromide; cosyl methyl bis(hydroxyethyl) ammonium chloride; cosyl tris(hydroxyethyl) ammonium bromide; dicosyl dimethyl hydroxyethyl ammonium bromide; dicosyl methyl bis(hydroxyethyl) ammonium chloride; dicosyl tris(hydroxyethyl) ammonium bromide; hexadecyl ethyl bis(hydroxyethyl) ammonium chloride; hexadecyl isopropyl bis(hydroxyethyl) ammonium iodide; and cetylamino, N-octadecyl pyridinium chloride.

Many fluids made with viscoelastic surfactant systems, for example those containing cationic surfactants having structures similar to that of erucyl bis(2-hydroxyethyl) methyl ammonium chloride, inherently have short re-heal times and the rheology enhancers of the present invention may not be needed except under special circumstances, for example at very low temperature.

Amphoteric viscoelastic surfactants are also suitable. Exemplary amphoteric viscoelastic surfactant systems include those described in U.S. Pat. No. 6,703,352 for example amine oxides. Other exemplary viscoelastic surfactant systems include those described in U.S. Patent Application Nos. 2002/0147114, 2005/0067165, and 2005/0137095. These four references are hereby incorporated in their entirety. Mixtures of zwitterionic surfactants and amphoteric surfactants are suitable. An example is a mixture of about 13% isopropanol, about 5% 1-butanol, about 15% ethylene glycol monobutyl ether, about 4% sodium chloride, about 30% water, about 30% cocoamidopropyl betaine, and about 2% cocoamidopropylamine oxide.

The viscoelastic surfactant system may also be based upon any suitable anionic surfactant. In some embodiments, the anionic surfactant is an alkyl sarcosinate. The alkyl sarcosinate can generally have any number of carbon atoms. Presently preferred alkyl sarcosinates have about 12 to about 24 carbon atoms. The alkyl sarcosinate can have about 14 to about 18 carbon atoms. Specific examples of the number of carbon atoms include 12, 14, 16, 18, 20, 22, and 24 carbon atoms. The anionic surfactant may be represented by the chemical formula:

$$R_1CON(R_2)CH_2X$$

wherein $R_1$ is a hydrophobic chain having about 12 to about 24 carbon atoms, $R_2$ is hydrogen, methyl, ethyl, propyl, or butyl, and X is carboxyl or sulfonyl. The hydrophobic chain can be an alkyl group, an alkenyl group, an alkylarylalkyl group, or an alkoxyalkyl group. Specific examples of the hydrophobic chain include a tetradecyl group, a hexadecyl group, an octadecentyl group, an octadecyl group, and a docosenoic group.

When a VES is incorporated into fluids used in embodiments of the invention, the VES can range from about 0.1% to about 15% by weight of total weight of fluid, preferably from about 0.5% to about 15% by weight of total weight of fluid, more preferably from about 2% to about 15% by weight of total weight of fluid. The lower limit of VES should no less than about 0.1, 0.2, 0.5, 0.7, 0.9, 1, 2, 3, 4, 5, 6, 7, 8, 9, 10, or 14 percent of total weight of fluid, and the upper limited being no more than about 15 percent of total fluid weight, specifically no greater than about 15, 14, 13, 12, 11, 10, 9, 8, 7, 6, 5, 1, 0.9, 0.7, 0.5, 0.3 or 0.2 percent of total weight of fluid. Fluids incorporating VES based viscosifiers may have any suitable viscosity, preferably a viscosity value of less than about 100 mPa-s at a shear rate of about 300 $s^{-1}$ at treatment temperature, more preferably less than about 100 mPa-s at a shear rate of about 100 $s^{-1}$, and even more preferably less than about 75 mPa-s.

The fracturing fluid may include fibers, which may be hydrophilic or hydrophobic in nature. Hydrophilic fibers are preferred. Fibers can be any fibrous material, such as, but not necessarily limited to, natural organic fibers, comminuted plant materials, synthetic polymer fibers (by non-limiting example polyester, polyaramide, polyamide, novoloid or a novoloid-type polymer), fibrillated synthetic organic fibers, ceramic fibers, inorganic fibers, metal fibers, metal filaments, carbon fibers, glass fibers, natural polymer fibers, and any mixtures thereof. Particularly useful fibers are polyester fibers coated to be highly hydrophilic, such as, but not limited to, DACRON® polyethylene terephthalate (PET), fibers available from Invista Corp., Wichita, Kans., USA, 67220. Other examples of useful fibers include, but are not limited to, polylactic acid polyester fibers, polyglycolic acid polyester fibers, polyvinyl alcohol fibers, and the like.

The fibrous material preferably has a length of about 1 to about 30 millimeters and a diameter of about 5 to about 100 microns, most preferably a length of about 2 to about 30 millimeters, and a diameter of about 5 to about 100 microns. Fiber cross-sections need not be circular and fibers need not be straight. If fibrillated fibers are used, the diameters of the individual fibrils can be much smaller than the aforementioned fiber diameters.

The concentrations of fibers between about 1 and about 15 grams per liter of fluid are effective. Preferably, the concentration of fibers are from about 2 to about 12 grams per liter of liquid, more preferably from about 2 to about 10 grams per liter of liquid. For fluids containing a viscoelastic surfactant viscosifying agent, the fiber amount is preferably from about 2 to about 5 grams per liter of liquid. For fluids including a crosslinked polymeric viscosifying agent, the fiber amount is preferably from about 2 to about 5 grams per liter of liquid. For fluids including a linear polymeric viscosifying agent, the fiber amount is preferably from about 5 to about 10 grams per liter of liquid.

The fluids may further comprise one or more members from the group of organic acids, organic acid salts, and inorganic salts. Mixtures of the above members are specifically contemplated as falling within the scope of the invention. This member will typically be present in only a minor amount (e.g., less than about 30% by weight of the liquid phase).

The organic acid is typically a sulfonic acid or a carboxylic acid, and the anionic counter-ion of the organic acid salts are typically sulfonates or carboxylates. Representative of such organic molecules include various aromatic sulfonates and carboxylates such as p-toluene sulfonate, naphthalene sulfonate, chlorobenzoic acid, salicylic acid, phthalic acid and the like, where such counter-ions are water-soluble. Most preferred as salicylate, phthalate, p-toluene sulfonate, hydroxynaphthalene carboxylates, e.g. 5-hydroxy-1-napthoic acid, 6-hydroxy-1-napthoic acid, 7-hydroxy-1-napthoic acid, 1-hydroxy-2-naphthoic acid, preferably 3-hydroxy-2-naphthoic acid, 5-hydroxy-2-naphthoic acid, 7-hydroxy-2-napthoic acid, and 1,3-dihydroxy-2-naphthoic acid and 3,4-dichlorobenzoate.

The inorganic salts that are particularly suitable include, but are not limited to, water-soluble potassium, sodium, and ammonium salts, such as potassium chloride and ammonium chloride. Additionally, calcium chloride, calcium bromide and zinc halide salts may also be used. The inorganic salts may aid in the development of increased viscosity that is characteristic of preferred fluids. Further, the inorganic salt may assist in maintaining the stability of a geologic formation to which the fluid is exposed. Formation stability and in particular clay stability (by inhibiting hydration of the clay) is achieved at a concentration level of a few percent by weight and as such the density of fluid is not significantly altered by the presence of the inorganic salt unless fluid density becomes an important consideration, at which point, heavier inorganic salts may be used.

Friction reducers may also be incorporated as viscosifying agents into the fracturing fluid. Any friction reducer may be used. Also, polymers such as polyacrylamide, polyisobutyl methacrylate, polymethyl methacrylate and polyisobutylene as well as water-soluble friction reducers such as guar gum, polyacrylamide and polyethylene oxide may be used. Commercial drag reducing chemicals such as those sold by Conoco Inc. under the trademark "CDR" as described in U.S. Pat. No. 3,692,676 or drag reducers such as those sold by Chemlink designated under the trademarks "FLO 1003, 1004, 1005 & 1008" have also been found to be effective. These polymeric species added as friction reducers or viscosity index improvers may also act as excellent fluid loss additives reducing or even eliminating the need for conventional fluid loss additives.

Breakers may be advantageously added to the fracturing fluid to "break" or diminish the viscosity of the fluid so that the fluid can be more easily recovered from the fracture during cleanup. With regard to breaking down viscosity, oxidizers, enzymes, or acids may be used. Breakers reduce the polymer's molecular weight by the action of an acid, an oxidizer, an enzyme, or some combination of these on the polymer itself. In the case of borate-crosslinked gels, increasing the pH and therefore increasing the effective concentration of the active crosslinker, the borate anion, reversibly create the borate crosslinks. Lowering the pH can just as easily eliminate the borate/polymer bonds. At a high pH above 8, the borate ion exists and is available to crosslink and cause gelling. At lower pH, the borate is tied up by hydrogen and is not available for crosslinking, thus gelation caused by borate ion is reversible. Citric acid may also be used as a breaker, as described in U.S. published patent application 2002/0004464 (Nelson et al.), filed on Apr. 4, 2001 and published on Jan. 10, 2002, which is incorporated herein by reference.

Embodiments of the invention may use fluids further containing other additives and chemicals that are known to be commonly used in oilfield applications by those skilled in the art. These include, but are not necessarily limited to, materials such as surfactants in addition to those mentioned hereinabove, breaker aids in addition to those mentioned hereinabove, oxygen scavengers, alcohols, scale inhibitors, corrosion inhibitors, fluid-loss additives, bactericides, and the like. Also, they may include a co-surfactant to optimize viscosity or to minimize the formation of stabilized emulsions.

While the fracturing fluid has been described as an aqueous medium based on produced water, it is preferable that before injecting the produced water into the injection well, a second fluid is introduced to create a highly conductive flow path with lower loading levels of a large diameter proppant. This second fluid is preferably a conventional fracturing fluid other than produced water. This pre-fracturing process has the advantage of an improved vertical sweep. With this pre-fracturing process, the produced water can be injected below fracture gradient, which is the pressure required to induce fractures in rock at a given depth. Injecting produced water at below the fracture gradient has the advantage of achieving a good injection profile across the whole interval without using large pumping equipment. In contrast, injecting above the fracture gradient can result in high injection of fluids into one zone thus reducing the overall efficiency and recovery of hydrocarbons from the layer not receiving injection.

Therefore, a controlled fracture treatment across the entire interval can be achieved by the fracturing method according to the teachings of the present disclosure. The controlled fracture treatment has the advantages of an improved injection profile, an improved injectivity rate over time, thereby minimizing or stabilizing the injectivity rate decline either above or below the fracture gradient.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method of treating a subterranean formation adjacent an injection well, the method comprising:

introducing a fracturing fluid into the subterranean formation to create a fracture, wherein the fracturing fluid is a conventional fracturing fluid other than produced water;

introducing proppant into the fracturing fluid, wherein the proppant has an average of 8/12 mesh size able to form a single layer of proppant in the fracture;

introducing subsequently produced water into the subterranean formation wherein the produced water is injected below fracture gradient.

2. The method according to claim 1, wherein the single layer of proppant is non-contiguous.

3. The method according to claim 1, wherein the proppant loading level is less than about 0.15 lb per gallon of the fracturing fluid.

4. The method according to claim 1, wherein the proppant has an average diameter of at least about 1.7 mm.

5. The method according to claim 1, wherein the proppant is coated with a resin.

6. The method according to claim 1, wherein the fracturing fluid comprises a viscosifying agent.

7. The method according to claim 6, wherein the viscosifying agent is selected from a group consisting of polymer and viscoelastic surfactants (VES).

8. The method according to claim 1, wherein the fracturing fluid further comprises a second aqueous medium.

9. The method according to claim 8, wherein the second aqueous medium is selected from a group consisting of seawater and brine.

10. The method according to claim 1, wherein the fracturing fluid further comprises a breaker.

11. A method of increasing the fluid injection rate into a subterranean formation adjacent an injection well, the method comprising:

introducing a fracturing fluid into the subterranean formation to create a fracture, wherein the fluid is a conventional fracturing fluid other than produced water;

introducing proppant into the fracturing fluid, wherein the proppant has an average of 8/12 mesh size able to form a single layer of proppant in the fracture;

introducing subsequently produced water into the subterranean formation wherein the produced water is injected below fracture gradient.

12. The method according to claim 11, wherein the single layer of proppant is non-contiguous.

13. The method according to claim 11, wherein the proppant loading level is less than about 0.15 lb per gallon of the fracturing fluid.

14. A method of increasing the formation face area in a subterranean formation adjacent an injection well, the method comprising:

introducing a fluid into the subterranean formation to create a fracture, wherein the fluid is a conventional fracturing fluid other than produced water;

introducing proppant into the pre-fracturing fluid, wherein the proppant has an average of 8/12 mesh size able to form a single layer of proppant in the fracture;

introducing subsequently produced water into the subterranean formation wherein the produced water is injected below fracture gradient.

* * * * *